United States Patent [19]

Coxon

[11] 4,304,524

[45] Dec. 8, 1981

[54] MARINE PROPELLERS

[75] Inventor: John R. Coxon, Pulborough, England

[73] Assignee: Woodcoxon Engineering (International) Limited, St. Helier, Channel Islands

[21] Appl. No.: 167,078

[22] Filed: Jul. 9, 1980

[30] Foreign Application Priority Data

Sep. 7, 1979 [GB] United Kingdom ..... 31100/79

[51] Int. Cl.[3] ..... B63H 3/00

[52] U.S. Cl. ..... 416/131; 416/202

[58] Field of Search ..... 416/131, 136, 202

[56] References Cited

U.S. PATENT DOCUMENTS 1,189,749 7/1916 Stodder ..... 416/131

FOREIGN PATENT DOCUMENTS 148641 2/1937 Austria ..... 416/131
904400 2/1954 Fed. Rep. of Germany ..... 416/202
2413199 10/1974 Fed. Rep. of Germany ..... 416/131
190499 3/1924 United Kingdom ..... 46/202
1414362 11/1975 United Kingdom ..... 416/202

*Primary Examiner*—Everette A. Powell, Jr.
*Attorney, Agent, or Firm*—Sughrue, Mion, Zinn, Macpeak and Seas

[57] ABSTRACT

A variable-pitch marine propeller comprises helicoidal blades 6 each mounted on a hub 1 to freely pivot about radial axis 25 spaced in front, in the direction of rotation, of the center of pressure of the blade 6 whereby water pressure acting on the blade exerts a torque which tends to turn it about its axis in a direction to bring the surfaces of the blade into line with the flow of water over it. The axis 25 is also spaced behind, with respect to the direction of movement of the propeller through the water, a major portion of the pressure surface of the blade whereby, the resultant of the drag of the water exerts a torque which tends to turn the blade in an opposite direction. The shape and mass distribution of the blades relative to their pivot axes are also such that centrifugal effects tend to move the blades, in the absence of hydrodynamic forces, into a pitch equal to that of the helicoid. In operation each blade adopts a stable equilibrium position in which its pitch is optimally suited to the speed of rotation and the linear axial speed of the propeller.

6 Claims, 5 Drawing Figures

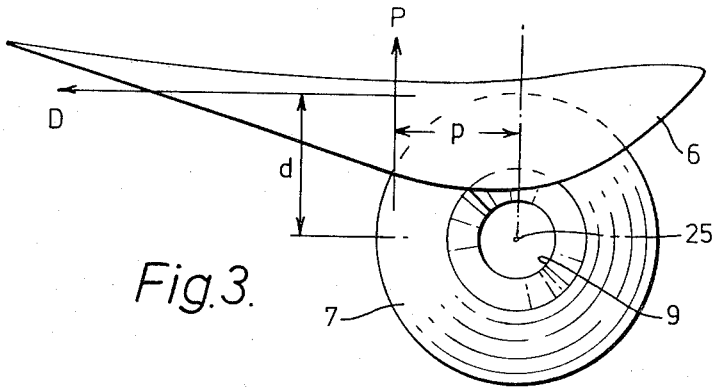
Fig.3.
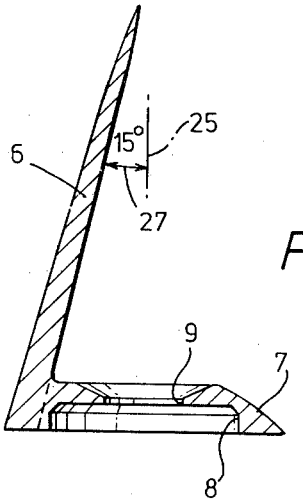
Fig.4.
Fig.5.
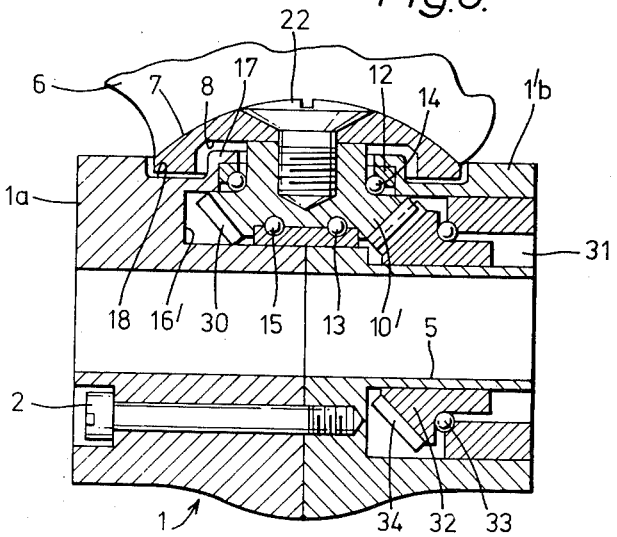

MARINE PROPELLERS

A problem which arises with propeller-driven marine craft, and especially with small high-speed planing motor boats is that a fixed-bladed propeller is very inefficient over some part of the speed range of the craft. If a propeller of coarse pitch is used which operates efficiently when the craft is moving at a speed at or near its maximum, a great deal of cavitation is produced when the craft is starting from rest or moving at a slow speed. In consequence the fuel consumption of the engine of the craft is higher than it need be at low speeds and the acceleration of the craft to higher speeds is also much less than it could be if the propeller were able to operate efficiently over a wider range of speeds. Indeed, the problem is so pronounced that with some very high speed racing boats, the cavitation is such that no thrust at all is produced when the boat is stationary and it is necessary for the boat to be towed up to a certain minimum speed before it can be propelled by its own engine and propeller.

This problem can be overcome entirely by the use of a variable pitch propeller. Most existing variable pitch propellers are hydraulically operated and are heavy, complex and consequently expensive.

It has previously been proposed, in German Specification No. 410401, to make a marine propeller which comprises two or more blades which are mounted on a hub so that the blades are free to pivot about a pivot axis which extends outwards from the hub with a radial component. Each blade is provided at its trailing edge with a trim tab which is so inclined to the remainder of the blade that, when the propeller is in operation, the tab exerts a torque on the blade which turns the blade about its pivot axis and holds it at a substantially constant angle of attack to the stream of water passing over the surfaces of the blade.

As far as is known, however, propellers as described in German Specification No. 410401 have never been made commercially and it is thought that this is because the provision of the trim tabs increases the drag of the water on the blades to such an extent that the advantage gained from the free pivoting of the blades to maintain a substantially constant angle of attack is largely nullified.

It has also been proposed in British specification No. 1,414,362 to make a marine propeller with blades which are freely pivoted on a hub so that they can turn about radial axes which are offset rearwardly, considered in relation to the direction to which the propeller moves axially through the water, from the pressure faces of the blades. The pivot axes are also in predetermined positions with respect to the leading edges of the blades and the location of the pivot axes in this way causes the resultant of the hydrodynamic forces acting on the blades to cause them to be self-adjusting in pitch.

Whilst this propeller may to some extent operate in the manner intended, it is believed that it has never been exploited on a commercial scale. It is thought that this may be because the blades are not self-adjusting in a stable manner over a sufficiently wide range of speeds and also because the blades will not remain stable at the optimum pitch when the craft to which the propeller is fitted is moving at its designed cruising speed. The maintenance of an optimum pitch at cruising speed is an essential requirement of any viable variable-pitch propeller because if the propeller does not have a sufficiently high efficiency at cruising speed, any other advantages which may accrue are of no avail.

The effect of centrifugal forces acting on the blades is mentioned in British Specification No. 1,414,362, but it is said that this effect is of secondary importance.

It is also stated in British Specification No. 1,414,362 that self-adjusting variable-pitch marine propellers have been proposed for many years, but no viable construction has been produced hitherto. This is believed to be true and indeed is still true up to the time of the making of the present invention.

We have now produced a marine propeller of the kind comprising two or more blades which are pivotally mounted on a hub so that they are free to pivot about axes extending radially outwards from the hub, the blades being arranged so that, in operation, they reliably adopt a pitch which is suited to the speed of rotation of the propeller and to the speed through the water of the craft to which the propeller is fitted, the pitch being both stable and substantially optimum over a wide range of speeds and especially at the designed cruising speed of the propeller.

The invention is based on the discovery that amongst other criteria, far from being secondary, the centrifugal effects acting on the blades are of paramount importance and must be specifically related to the hydrodynamic forces which also act on the blades. The rake of the blades relative to their pivot axes and the shape of the blades, especially the location of the trailing edge portions of the blades, in relation to their pivot axes have also been found to be critical.

Thus, according to the present invention, in a marine propeller comprising two or more blades which are pivotally mounted on a hub so that they are free to pivot about axes extending radially outwards from the hub, the pivot axes being displaced rearwardly, considered in relation to the direction in which, in operation, the propeller moves axially through the water, of the pressure faces of the blades, the blades and their pivot axes have the following features:

(a) The blades are helicoidal;

(b) The mass distribution of each blade relative to its pivot axis is such that the centre of mass of the blade is spaced behind the pivot axis of the blade considered in relation to the direction of rotation of the blade and such that, when the propeller is rotated, in the absence of hydrodynamic forces, centrifugal effects cause the blade to adopt a pitch substantially equal to the pitch of the helicoid;

(c) Each blade is raked rearwardly relative to the propeller plane with a mean angle of rake of at least 10° multiplied by the Pitch Ratio of the propeller and divided by the Aspect Ratio of the blade; and, (d) Each blade has a skewed-back shape with the trailing tip of the blade spaced behind the pivot axis of the blade, considered in relation to the direction of rotation of the blade, by a distance equal to at least 60% of the maximum width of the blade, and the position of the pivot axis in relation to the shape and the rake angle of the blade is such that, in operation, hydrodynamic lift and drag on the blade acting in combination with the centrifugal effects cause the blade to adopt, over a range of rotational and axial speeds, a position such that it has an angle of incidence to the stream of water passing over it which produces a substantially optimum thrust.

Since the propeller has a variable pitch, the Pitch Ratio is defined as the pitch of the helicoid to which the blades are formed divided by the diameter of the propeller. The Aspect Ratio of the blade is defined as the maximum radius of the blade measured from the axis of rotation of the propeller divided by the maximum width of the blade and is thus inversely proportional to the Blade Width Ratio. The pressure face of the blade may be substantially straight as seen in section on the propeller reference line and in this case the rake angle of the blade is constant. Alternatively the pressure face may be curved as seen in this section and in this case the rake angle will vary from the root to the tip of the blade. The mean angle of rake is the mean angle between the axis of rotation of the propeller and the pressure face of the blade in section on the propeller reference line.

Whilst the pivot axes of the blades may extend outwards in planes which are exactly radial to the axis of rotation of the propeller, they may alternatively be inclined to some extent to radial planes and the term "extending radially outwards" is intended to be construed as covering both of these arrangements provided that the axes extend outwards from the axis of rotation of the propeller with major radial components. Further, the pivot axes may lie in a plane normal to the axis of rotation of the propeller and for most purposes this is preferred. In some cases, however, the pivot axes may be raked either forwards or rearwards from this plane.

With a propeller having all the characteristics just described, the blades will adopt a stable pitch which is suited to the rotational and axial speeds of the propeller over a wide range of both of these speeds. It is believed that such stability has not previously been achieved.

Preferably the pivot axis of each blade is so located that, when the blade is pivoted into a position of minimum pitch, a plane containing the pivot axis and the axis of rotation of the propeller divides the blade area in a ratio of substantially 3:1, substantially one quarter of the area being in front of the pivot axis and substantially three quarters of the area being behind the pivot axis in the direction of rotation of the propeller.

Each blade may be pivoted so that it can only turn about its pivot axis within predetermined limits, which are set by stops, to provide a variation in pitch between a minimum and a maximum. In this case, if the propeller is driven in an astern direction, it will always adopt its maximum pitch and there will be no self-adjustment. Preferably therefore, the blade are pivotally mounted so that they can rotate freely in all directions. With this arrangement, if the propeller shaft is rotated in an ahead direction, the blades will turn to produce an angle of attack to provide forward thrust and when the propeller shaft is rotated in an opposite direction, the blades will turn about their pivot axes through almost 180 degrees to give the same angle of attack in an astern direction and hence a reverse thrust. Owing to this rotation of the blades through almost 180 degrees, the pivot axes of the blades are still spaced behind the pressure faces of the blades since the blades are now travelling through the water in an opposite axial direction.

Each of the blades may be pivotally mounted on the hub entirely independently of the other blades and this, for most purposes, is the preferred arrangement. Alternatively, however, the blades may be mechanically interconnected within the hub so that they are constrained to turn about their pivot axes in unison and all the blades adopt the same instantaneous pitch.

The blades are preferably, as is usual, of aerofoil cross-section and then the pressure acting on the blade as the blade is rotated is increased by the hydrodynamic lift of the blade. The total drag on the blade is also increased insofar that the drag then consists of the frictional drag of the water on the blade together with a drag component of the hydrodynamic forces acting on the aerofoil section.

Two examples of propellers in accordance with the invention will now be described with reference to the accompanying drawings, in which:

FIG. 3 is an elevation of one of the blades of the first example as seen looking radially inwards towards the axis of rotation of the propeller;

FIG. 4 is a section as seen in the direction of the arrows on the line IV—IV of FIG. 3; and, FIG. 5 is an axial section through a second example showing a part only of one of the blades.

Figure 1:
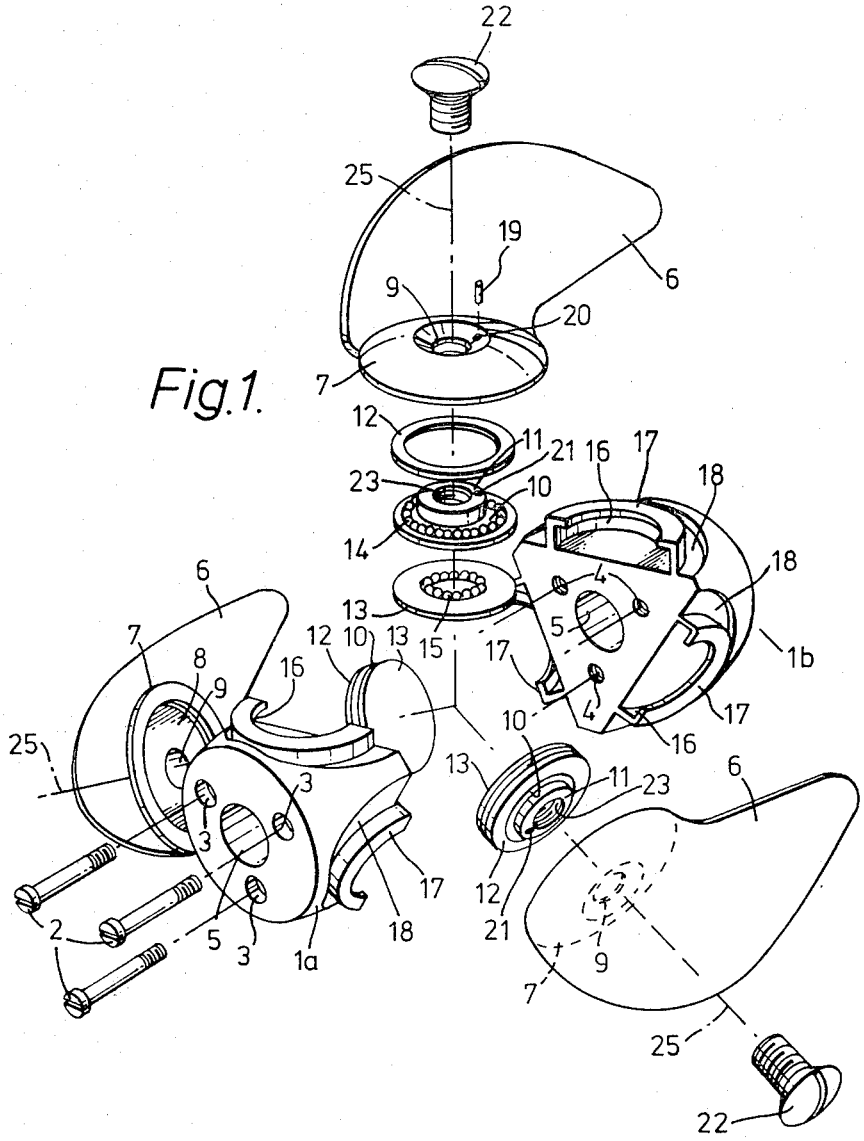
FIG. 1 is an exploded perspective view of one example.

The first example illustrated in FIGS. 1 to 4 has helicoidal blades, the pitch of the helix being 200 mm. The diameter of the propeller is also 200 mm so that the Pitch Ratio of the propeller is 1. The blade width is 124 mm and the Aspect Ratio is accordingly approximately 0.8.

The propeller shown in FIGS. 1 to 4 has a hub 1 formed in two parts 1*a* and 1*b*. The parts 1*a* and 1*b* mate on a central plane which is normal to the axis of rotation of the propeller and are fixed together by three screws 2 which pass freely through bores 3 in the part 1*a* and are screwed into tapped bores 4 in the part 1*b*. The parts 1*a* and 1*b* also have a central bore 5 in which, in use, a propeller shaft fits.

The propeller has three blades 6 which are identical to each other and the blades are all pivotally mounted on the hub 1 in the same way as each other. Accordingly only one of the blades and its attachment to the hub 1 will be described.

The blade 6 is cast integrally with a circular boss 7 which has a cylindrical recess 8 in its underside and has a central countersunk bore 9 which is coaxial with the pivot axis about which the blade 6 is freely rotatable relative to the hub 1.

A radial and thrust ball bearing comprises a rotatable bearing ring 10 with a projecting collar 11 and two fixed bearing rings 12 and 13. A first ring of balls 14 is interposed between the rings 10 and 12 and a second ring of balls 15 is interposed between the rings 10 and 13. The bearing is assembled and it is then inserted in a cylindrical socket 16 in the hub 1. The socket 16 is formed as the hub parts 1*a* and 1*b* are mated with each other, and as will be seen, the the bearing assembly can only be inserted before the hub parts 1*a* and 1*b* are mated with each other and then fixed together and once the hub parts have been fixed together, the bearing assembly is held in position in the hub by an inwardly directed flange 17.

The boss 7 of the blade is then fitted over the socket 16 containing the bearing assembly and over the flange 17 with the rim of the boss 7 fitting within an annular groove 18. The assembled position is shown most clearly in FIG. 2.

To hold the blade 6 with its boss 7 in position, firstly a pin 19 is inserted through a small aperture 20 in the boss 7 and then into a registering aperture 21 in the collar 11. This prevents the bearing ring 10 from rotating relative to the boss 7 and then a screw 22 is inserted through the bore 9 and is screwed into a tapped bore 23 in the collar 11. This clamps the underside of the boss 7 tightly against the upper surface of the collar 11 as shown most clearly in FIG. 2 so that the boss 7 is able to rotate with the bearing ring 10 which is itself freely rotatable within the socket 16.

Figure 2:
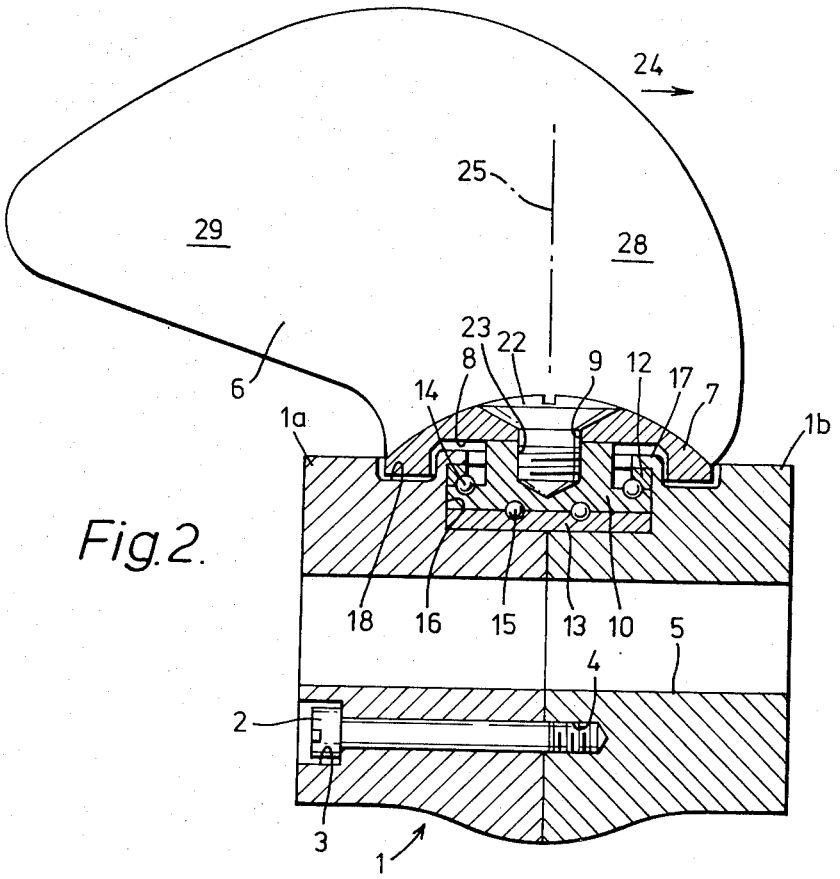
FIG. 2 is an axial section through the first example showing one of the blades of the propeller in plan, that is as seen in a direction in which the blade presents a maximum projected area.

As is shown most clearly in FIG. 2 the ring of balls 14 withstands radial loads on the bearing assembly and also axial loads radially outwards along the pivot axis of the blade. The ring of balls 15 withstands inward axial thrust.

In this example the pivot axes of all three blades lie in a plane which is normal to the axis of rotation of the propeller, that is the axis of the bore 5. The blades move through the water in the direction of an arrow 24 shown in FIG. 2. The centre of pressure of the blade is spaced behind the pivot axis 25 of the blade, that is nearer the trailing edge of the blade, but this distance varies in dependence upon the angle of incidence of the blade and upon other factors. Thus the resultant P of the pressure acting upon the blade acts at a variable distance p from the axis 25 as is shown in FIG. 3. As is also shown in FIG. 3, the resultant D of the drag on the blade acts at a distance d from the pivot axis 25 and this distance also varies to some extent. However the torques on blade produced by the resultant pressure and drag act in opposite directions.

As is shown in FIG. 4, the blade has a rake angle 27 of 15 degrees. In this example the pressure face of the blade is straight in the section shown in FIG. 4 and therefore the rake angle is constant. The blade may however be radially curved so that the rake angle varies radially. It is the mean rake angle which is then of importance.

The pivot axis 25, as seen in FIG. 2, divides the blade into an area 28 in front of the pivot axis and an area 29 behind the pivot axis. The area 29 is substantially three times the area 28.

The skewed-back shape of the blades together with their rake relative to their pivot axes and the location of the pivot axes causes the mass distribution of the blades relative to the pivot axes and to the axis of rotation of the propeller to be such that centrifugal effects move the blades until their pressure faces lie substantially on a common helicoidal surface of 200 mm pitch when the propeller is rotated in a vacuum and at a speed such that gravitational forces become negligible.

The second example shown in FIG. 5 of the drawings is the same in all respects as the first example except that the blades are interconnected within the hub 1 by meshing gearwheels so that the blades are all constrained to turn about their pivot axes in unison with each other.

For this purpose, the hub 1 has a socket 16' of somewhat greater radial extent than the socket 16 of the first example. Also, in place of the bearing ring 10 of the first example, there is a bearing ring 10', which has a greater radial extent than the bearing ring 10 and is provided with bevel gear teeth 30. The hub 1 comprises a part 1*a* similar to the part 1*a* of the first example and a part 1'*b* which is similar to the part 1*b* of the first example except that it is provided with an axially extending annular groove 31 which is concentric with the bore 5 and intersects the sockets 16'. The annular groove 31 contains a bevel gear wheel 32 which is supported by a ball bearing 33 and has bevel gear teeth 34 which mesh with the teeth 30 of the bearing rings 10' of all three blades.

Propellers in accordance with the invention have very great advantages which vary in dependence upon the purpose of the craft to which the propellers are fitted. Thus in small outboard motor boats, such as are used for towing water skiers, acceleration of the boat may be greatly improved and is greatly helped in pulling the skier quickly through the critical speed at which the skier's ski or skis start to plane. Further, and this is of the greatest importance in the present days of fuel shortage, with displacement hulls and other hulls which are intended to be operated over a quite a wide range of speeds, owing to the ability of the propeller to adapt its pitch to the speed of the boat, the efficiency of the propeller is maintained at a maximum value over the whole speed range of the boat. This gives rise to a very great drop in overall fuel consumption when the boat is being driven at any speed below the maximum which can be produced by the engine with which it is fitted. Not only does the drop in fuel consumption give rise to considerably increased economy, but it also produces a greatly increased range for a boat with a given fuel tank volume. This can be of considerable importance particularly for fishing boats.

Propellers in accordance with the invention can also be used to advantage on trawlers. Trawlers are required to sail to their fishing grounds at a speed which is as high as possible subject to the requirement of reasonable fuel economy, but when fishing they are required to sail very much more slowly and yet their propellers must produce sufficient thrust to drag the trawl. A fixed bladed propeller cannot be efficient under both these circumstances and it is not unusual therefore for trawlers to be fitted with propellers the blades of which can be adjusted to either one of two different pitches. This adjustment is, however, carried out hydraulically or by a complex mechanical arrangement and such propellers are therefore very expensive. Propellers in accordance with the invention will achieve the same desirable effects as these variable pitch propellers, but at a much smaller cost.

Propellers in accordance with the invention can produce an astern thrust on a boat moving forwards very much more quickly than can a conventional fixed-bladed propeller. This enables the boat to be stopped very much more quickly and greatly improves safety. The reason for this is that with a fixed-bladed propeller, the direction of flow of the water over the surfaces of the blades is such that when the propeller is first rotated in an astern direction as opposed to moving ahead, the cavitation produced by the propeller is very great indeed and in consequence the astern thrust is minimal. With propellers in accordance with the present invention, however, even though the propeller shaft may be rotated at full speed in an ahead direction and then be at once reversed and rotated at full speed in an astern direction, the blades will at once assume their correct angle of attack relative to the direction of the stream of water passing over their surfaces. Accordingly considerable astern thrust is at once developed.

Finally, propellers in accordance with the invention have great advantages when used on steeply inclined propeller shafts. The efficiency of fixed-bladed propellers falls rapidly with an increase of inclination of the shaft on which the propeller is mounted because the inclination causes the angle of incidence of the blades to vary in each revolution as the propeller rotates. The blades of propellers in accordance with the invention, however, oscillate about their pivot axes when fitted to inclined shafts and the pitch of the blades thus varies cyclically as the propeller rotates. This gives rise to a remarkable increase in efficiency. This advantage is of particular significance with hydrofoil craft where very steeply inclined shafts cannot be avoided.

I claim:

1. In a propeller comprising a hub, at least two blades, means pivotally mounting said blades on said hub for movement about axes extending radially outwards from said hub, said propeller having an axis of rotation, a propeller plane and a Pitch Ratio, said blades having pressure faces, an Aspect Ratio and a maximum width, and said pivot axes being displaced rearwardly of said pressure faces relative to the direction in which said propeller moves axially through the water, the improvements characterized by:

(a) each blade being shaped as a helicoid having a pitch;

(b) the mass distribution of each blade relative to its pivot axis being such that the center of mass of the blade is spaced behind its pivot axis relative to the direction of rotation of said blade, and such that when said propeller is rotated in the absence of hydrodynamic forces, centrifugal effects cause said blade to adopt a pitch substantially equal to the pitch of said helicoid;

(c) each blade being raked rearwardly relative to said propeller plane with a mean angle of rake of at least 10° multiplied by said Pitch Ratio and divided by said Aspect Ratio;

(d) each blade having a skewed-back shape and including a trailing tip spaced behind the pivot axis of said blade, relative to the direction of rotation of the blade, by a distance equal to at least 60% of the maximum width of said blade; and (e) the position of each pivot axis in relation to the shape and angle of rake of its associated blade being such that hydrodynamic lift and drag on said blade acting in combination with said centrifugal effects cause said blade to adopt, over a range of rotational and axial speeds, a position such that said blade has an angle of incidence to a stream of water passing over it which produces a substantially optimum thrust.

2. A propeller as claimed in claim 1, in which the pivot axis of each blade is located such that, when said blade is pivoted into a position of minimum pitch, a plane containing said pivot axis and the axis of rotation of said propeller divides the area of said blade in a ratio of about 3:1, with about one quarter of said area lying in front of said pivot axis and about three quarters of said area lying behind said pivot axis in the direction of rotation of said propeller.

3. A propeller as claimed in claim 1, in which said pivot axes lie in a plane normal to the axis of rotation of said propeller.

4. A propeller as claimed in claim 1, in which said blades are freely rotatable in all directions about said pivot axes.

5. A propeller as claimed in claim 1, further comprising means within said hub mechanically interconnecting said blades for constraining them to turn about said pivot axes in unison, whereby all of said blades adopt the same instantaneous pitch.

6. A propeller as claimed in claim 5, in which said interconnecting means comprises a plurality of meshing gear wheels, means rotatably mounting said gear wheels in said hub, and means individually rigidly connecting said gear wheels to said blades.

* * * * *